United States Patent [19]

Fryberg et al.

[11] Patent Number: 4,576,885

[45] Date of Patent: Mar. 18, 1986

[54] PHOTOGRAPHIC MATERIAL FOR THE SILVER DYE BLEACH PROCESS

[75] Inventors: Mario Fryberg, Praroman-le-Mouret; Heinrich Schaller, Fribourg; Rolf Steiger, Praroman; Heinz Peter, Rheinfelden, all of Switzerland

[73] Assignee: Ciba-Geigy AG, Basel, Switzerland

[21] Appl. No.: 571,018

[22] Filed: Jan. 16, 1984

[30] Foreign Application Priority Data

Jan. 26, 1983 [CH] Switzerland ..... 425/83

[51] Int. Cl.[4] ..... G03C 7/32

[52] U.S. Cl. ..... 430/390; 430/392; 430/559; 430/561

[58] Field of Search ..... 430/390, 392, 559, 561, 430/504, 17

[56] References Cited

U.S. PATENT DOCUMENTS

| | | | |
|---|---|---|---|
| 3,457,074 | 7/1969 | Wilson et al. | 430/503 |
| 3,782,948 | 1/1974 | Froehlich et al. | 430/561 |
| 4,242,441 | 12/1980 | Nakamura et al. | 430/390 |

FOREIGN PATENT DOCUMENTS

| | | |
|---|---|---|
| 93696 | 4/1983 | European Pat. Off. . |
| 1159690 | 7/1969 | United Kingdom . |

OTHER PUBLICATIONS

Japan Patent Abstracts, vol. 1, No. 92, Aug. 25, 1977, p. 2506 E 77.

*Primary Examiner*—J. Travis Brown

*Attorney, Agent, or Firm*—Joseph G. Kolodny

[57] ABSTRACT

A photographic silver dye bleach material which contains a compound of the formula in which R is a substituted alkyl, $R_1$ is substituted or unsubstituted alkyl, p is 1 or 2, q is 0 or 1, p+q having to be 1 or 2, and n is 1 to 20, or a salt of this compound.

The benzoquinones used deactivate bleach catalysts which diffuse beyond the silver image area produced by development of the exposed material. The silver dye bleach material containing these compounds is therefore distinguished by high contrast, high sharpness and good color reproduction.

13 Claims, 3 Drawing Figures

PHOTOGRAPHIC MATERIAL FOR THE SILVER DYE BLEACH PROCESS

Figure 1:
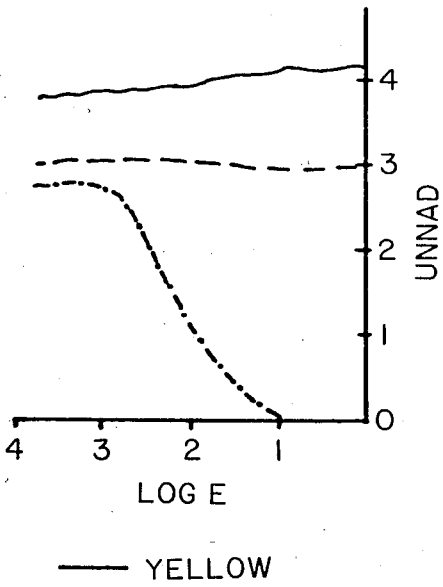

The present invention relates to photographic material for the silver dye bleach process, which material contains, in at least one layer, at least one bleach inhibitor.

In the silver dye bleach process, as is known, a negative silver image is first developed in the exposed material by means of a black-and-white developer. The material is then bleached, the silver of the silver image being oxydised (bleached) to a silver salt and the dye being at the same time reduced (bleached) (imagewise) corresponding to the original silver image areas. Subsequently, the silver salt still present is removed by fixing and the material is washed. For bleaching, one or more dye bleach catalysts are as a rule used, for example quinoxalines, pyrazines of phenazines, which are described, for example, in German Specifications No. DE-B-1,547,720 and No. DE-B-1,547,759.

Recording materials which are particularly suitable for the silver dye bleach process contain, on a support, red-sensitive, green-sensitive and blue-sensitive silver halide emulsion layers which contain bleachable cyan dyes, magenta dyes and yellow dyes.

These dyes can also be incorporated into separate layers which are adjacent to the silver halide emulsion layers.

On bleaching of the silver, the bleach catalysts in the silver image areas are reduced. In the reduced form, the bleach catalysts accelerate the dye bleaching in the exposed areas. To produce a sharp image rich in contrast, it is desirable that the dye is bleached only in the silver image areas. It has been found, however, that reduced bleach catalysts also diffuse into adjacent layers and can cause bleaching of dyes therein. This leads to an undesired reduction in dye density in this layer and eventually to false colours in the colour image.

In the past, the use of p-quinones with a ballast group has been proposed in U.S. Pat. No. 3,457,074. These diffusion-resistant oxidising agents can partially oxidise the reduced bleach catalysts and can thus make them ineffective as such. The disadvantage of these quinones is, however, that their activity is low and they are sparingly soluble in the usual solvents. For this reason, a large quantity of solvent must be used in order to obtain an optimum distribution of the quinones in the photographic layer and also in order to prevent these compounds from crystallising out.

According to U.S. Pat. No. 3,782,948, nitro compounds are employed as the oxidising agents in place of p-quinones. The results obtained with these compounds are, however, unsatisfactory. Moreover, the nitro compounds cannot in all cases be incorporated into the photographic layers in the desired distribution.

Binuclear heterocyclic compounds are used according to German Specification No. DE-A-2,949,167. However, these have the disadvantage that they unfavourably affect the kinetics of silver development.

It is thus the object of the present invention to prevent the undesired bleaching of image dyes by diffusing reduced bleach catalysts and, at the same time, as far as possible to overcome the disadvantages of the solutions hitherto proposed. According to the invention, the object is achieved when 1,4-benzoquinones are incorporated into silver dye bleach materials. These compounds are diffusion-resistant and they are distinguished by a good bleach-inhibiting activity.

The present invention therefore relates to a photographic silver dye bleach material which, in at least one layer, contains at least one compound of the formula

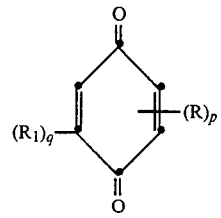

(1)

in which R is a radical of the formula

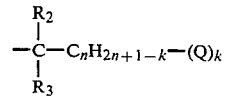

(2)

in which Q is $—CO_2R_4$ or $—CONR_4R_5$, in which $R_4$ is alkyl having 1 to 20 carbon atoms, which is unsubstituted or is substituted by $—OR_6$, in which $R_6$ is cycloalkyl having 3 to 12 carbon atoms, alkenyl having 3 to 20 carbon atoms, aryl having 6 to 10 carbon atoms, which is unsubstituted or is monosubstituted or disubstituted by alkyl groups having 1 to 4 carbon atoms each, or aralkyl having 7 to 13 carbon atoms, and which may contain 1 to 5 oxygen atoms, or $R_4$ is alkenyl having 3 to 20 carbon atoms, cycloalkyl having 3 to 12 carbon atoms, aryl having 6 to 10 carbon atoms, which is unsubstituted or is substituted by alkyl having 1 to 4 carbon atoms, or is aralkyl having 7 to 13 carbon atoms, a heterocyclic ring which contains an oxygen or a nitrogen atom and is unsubstituted or substituted by 1, 2 or 4 alkyl groups having 1 to 4 carbon atoms each, or is methyl substituted by a 5-membered or 6-membered heterocyclic ring which contains an oxygen atom and is unsubstituted or is monosubstituted or disubstituted by alkyl groups having 1 to 4 carbon atoms each, $R_5$ is hydrogen or alkyl having 1 to 20 carbon atoms or $R_4$ and $R_5$, together with the nitrogen atom to which they are linked, form a 5-membered or 6-membered ring which is unsubstituted or is monosubstituted or disubstituted by alkyl groups having 1 to 4 carbon atoms each, or Q is —OX, in which X is $R_5$ or $—COR_7$, in which $R_5$ is as defined and $R_7$ is alkyl having 1 to 20 carbon atoms, alkenyl having 3 to 20 carbon atoms, cycloalkyl having 3 to 12 carbon atoms, aralkyl having 7 to 13 carbon atoms or aryl having 6 to 10 carbon atoms, which is unsubstituted or is monosubstituted or disubstituted by alkyl groups having 1 to 4 carbon atoms each, or Q is $—NR_8R_9$, in which $R_8$ is hydrogen or alkyl having 1 to 4 carbon atoms and $R_9$ is hydrogen, alkyl having 1 to 4 carbon atoms or $—COR_7$, in which $R_7$ is as defined above, or $R_8$ and $R_9$, together with the nitrogen atom to which they are linked, form a 5-membered or 6-membered ring which is unsubstituted or is monosubstituted or disubstituted by alkyl groups having 1 to 4 carbon atoms each, or Q is $—P(O)(OR_{10})(|O|_xR_{11})$, in which x is 0 or 1, and, if x=1, $R_{10}$ and $R_{11}$ independently of one another are hydrogen or alkyl having 1 to 20 carbon atoms, or $R_{10}$ and $R_{11}$ form an alkylene group having 2 or 3 carbon atoms, which is unsubstituted or is monosubstituted or polysubstituted by alkyl groups having 1 to 20 carbon atoms each, or, if $x=0$, $R_{10}$ is hydrogen or alkyl having 1 to 20 carbon atoms and $R_{11}$ is unbranched alkyl having 1 to 5 carbon atoms, or Q is $-SO_2R_{12}$, in which $R_{12}$ is hydroxy, chlorine or $-NR_5R_7$, in which $R_5$ and $R_7$ are as defined, $R_1$ being a radical of the formula (2) if $R_{12}$ is hydroxy, or Q is cyano, $R_2$ and $R_3$ independently of one another are hydrogen or alkyl having 1 to 5 carbon atoms and, if Q is $CO_2R_4$, $R_2$ or $R_3$ may be substituted by $-CO_2R_4$, or $R_2$ and $R_3$ can, together with the radical of the formula $-C_nH_{2n+1-k}$, form a cycloalkyl radical having 5 to 12 carbon atoms, which is monosubstituted or disubstituted by groups of the formula $-CO_2R_4$, in which $R_4$ is as defined, $R_1$ is alkyl having 1 to 8 carbon atoms or a radical of the formula (2), p is 1 or 2, q is 0 or 1, $p+q$ having to be 1 or 2, n is 1 to 20 and k is 1 or 2, or a salt of the compound of the formula (1).

The present invention furthermore relates to processes for the preparation of the material according to the invention, to the use of the 1,4-benzoquinones in photographic silver dye bleach material and to the photographic image produced with this material.

In the formula (1), the groups R are alkyl, preferably of the formula $$-\underset{R_3}{\overset{R_2}{\underset{|}{\overset{|}{C}}}}-C_nH_{2n+1-k}(Q)_k. \qquad (2)$$

In this formula, Q is a group of the formula $-CO_2R_4$ or $-CONR_4R_5$. $R_4$ is hydrogen or alkyl preferably having 1 to 20, in particular 1 to 10, carbon atoms. Examples of suitable alkyl radicals are methyl, ethyl, propyl, butyl, pentyl, hexyl, octyl, decyl, dodecyl, hexadecyl, octadecyl and eicosyl. The alkyl radicals $R_4$ can also be in the form of their branched isomers. Moreover, the alkyl radicals can contain 1 to 5 oxygen atoms in the carbon chain, for example $-CH_2CH_2OCH_3$, $-CH_2CH_2OC_2H_5$, $(C_2H_4O)_2CH_3$ or $(C_2H_4O)_5CH_3$. The alkyl radicals $R_4$ are substituted or unsubstituted. An example of a substituent is the group of the formula $-OR_6$. In the latter, $R_6$ is cycloalkyl, preferably having 3 to 12 carbon atoms, for example cyclopentyl, methylcyclopentyl, cyclohexyl, methylcyclohexyl and cyclooctyl. $R_6$ can also be alkenyl, preferably having 3 to 20 carbon atoms. Suitable alkenyl radicals can be derived from the alkyl radicals mentioned for $R_4$. Furthermore, $R_6$ can be aryl having preferably 6 to 10 carbon atoms, for example phenyl or naphthyl. These aryl radicals can be substituted by preferably 1 or 2 further alkyl groups, these alkyl groups especially having 1 to 4 carbon atoms, for example methyl, ethyl, propyl or butyl. $R_6$ can also be aralkyl. Suitable aralkyl radicals contain 7 to 13 carbon atoms, for example benzyl, naphthylmethyl, phenylethyl or benzhydryl. $R_4$ can also be alkenyl, suitable alkenyl groups containing 3 to 20 carbon atoms. These can be derived from the alkyl radicals mentioned. Cycloalkyl groups $R_4$ contain 3 to 12 carbon atoms, cyclopropyl, cyclopentyl, cyclohexyl and cyclooctyl being particularly preferred. Aryl groups $R_4$ are preferably those having 6 to 10 carbon atoms, for example phenyl and naphthyl, it being possible for these groups to be substituted by alkyl radicals, for example methyl, ethyl, propyl, butyl and isomers thereof. $R_4$ can also be an aralkyl group which preferably contains 7 to 13 carbon atoms. Suitable aralkyl groups are those listed for $R_6$. Furthermore, $R_4$ can be a 5-membered or 6-membered heterocyclic ring which contains an oxygen atom or nitrogen atom, for example tetrahydrofuranyl or tetrahydropyranyl and piperidinyl or pyrrolidinyl, it being possible for the rings to be substituted by preferably 1 to 4 alkyl groups having 1 to 4 carbon atoms (each). $R_4$ can also be a methyl group which is substituted by one of the heterocyclic rings mentioned. For example, $R_4$ can also be furfuryl or tetrahydrofurfuryl. These radicals can also be further substituted by preferably 1 or 2 alkyl groups having 1 to 4 carbon atoms (each).

$R_5$ in the formula $-CONR_4R_5$ is hydrogen or alkyl having preferably 1 to 20 carbon atoms. Suitable alkyl radicals are those listed for $R_4$.

$R_4$ and $R_5$ can, together with the nitrogen atom to which they are linked, form a 5-membered or 6-membered heterocyclic ring. Examples are pyrrolidinyl, piperidinyl or morpholinyl. The rings can be substituted by preferably 1 or 2-alkyl groups which, as a rule, contain 1 to 4 carbon atoms.

Furthermore, Q can be a group of the formula $-OX$, in which X is $R_5$—as defined above, but in particular alkyl having 3 or 4 carbon atoms, or hydrogen—or is $COR_7$. $R_7$ is alkyl having preferably 1 to 20 carbon atoms. Suitable alkyl radicals are those listed for $R_4$, in particular those having 1 to 4 carbon atoms, methyl being particularly preferred. $R_7$ can also be alkenyl, preferably having 3 to 20 carbon atoms. These alkenyl radicals can be derived from the alkyl radicals mentioned. Cycloalkyl $R_7$ having preferably 3 to 12 carbon atoms is especially cyclopentyl, cyclohexyl or cyclooctyl. Suitable aralkyl groups $R_7$, preferably containing 7 to 13 carbon atoms, are those listed for $R_6$. $R_7$ can also be aryl having preferably 6 to 10 carbon atoms, for example phenyl and naphthyl. The aryl groups may be monosubstituted or disubstituted by alkyl groups, preferably having 1 to 4 carbon atoms (each).

Q can also be a group of the formula $-NR_8R_9$, in which $R_8$, besides hydrogen, is alkyl having preferably 1 to 4 carbon atoms, for examwple methyl, ethyl, propyl or butyl or isomers thereof, and $R_9$ is hydrogen or alkyl having preferably 1 to 4 carbon atoms or a radical of the formula $-COR_7$, in which $R_7$ is as defined. Together with the nitrogen atom to which they are linked, $R_8$ and $R_9$ can form a 5-membered or 6-membered ring which is unsubstituted or is monosubstituted or disubstituted by alkyl groups containing preferably 1 to 4 carbon atoms (each). Examples of preferred rings are pyrrolidinyl, piperidinyl or morpholinyl.

Q can also be a radical of the formula $-P(O)(OR_{10})(|O|_xR_{11})$, in which x is 0 or 1. If $x=1$, $R_{10}$ and $R_{11}$ independently of one another are hydrogen or alkyl having 1 to 20 carbon atoms, the alkyl radicals listed for $R_4$ being particularly suitable. If $x=1$, $R_{10}$ and $R_{11}$ can also form an alkylene chain which preferably contains 2 or 3 carbon atoms and which in turn can be substituted by one of the above alkyl radicals having 1 to 20 carbon atoms. If $x=0$, $R_{10}$ is hydrogen or alkyl having 1 to 20 carbon atoms. Suitable alkyl radicals $R_{10}$ are those listed for $R_4$. If $x=0$, $R_{11}$ is alkyl having 1 to 5 carbon atoms, the alkyl radicals preferably being unbranched.

Furthermore, Q can be a group of the formula $-SO_2R_{12}$, in which $R_{12}$ is hydroxy, halogen, for example chlorine, or $-NR_5R_7$, $R_5$ and $R_7$ being as defined. If $R_{12}$ is hydroxy, $R_1$ is a radical of the formula (2).

Q can also be cyano.

$R_2$ and $R_3$ in the formula (2) are independently of one another hydrogen or alkyl, preferably having 1 to 5 carbon atoms, for example methyl, ethyl, propyl, butyl, pentyl or isomers thereof, methyl being particularly preferred. If Q is $—CO_2R_4$, either $R_2$ or $R_3$ is in that case substituted by $—CO_2R_4$, the two substituents $R_4$ independently of one another being as defined. $R_2$ and $R_3$ can also be bonded to the $C_nH_{2n+1-k}$ chain in such a way that a cycloalkyl radical is formed which preferably has 5 to 12 carbon atoms and is monosubstituted or disubstituted by $—CO_2R_4$ groups. The two substituents $R_4$ independently of one another are as defined above.

n is preferably a number from 1 to 20, in particular 3 to 7, and p and k are 1 or 2, but preferably 1.

q is 0 or preferably 1.

$R_1$ in the formula (1) is alkyl. Suitable alkyl radicals contain 1 to 8 carbon atoms, examples being methyl, ethyl, propyl, butyl, pentyl, hexyl, heptyl, octyl or isomers thereof. $R_1$ can also be a radical of the formula (2), in which case $R_1$ and R can be identical or different. Particularly suitable radicals $R_1$ are alkyl radicals having 1 to 4 carbon atoms, branched isomers, for example t-butyl, being preferred.

The compounds of the formula (1) can also be present in the form of salts.

Those compounds of the formula (1) are preferred for use in photographic silver dye bleach materials in which R occupies the 2-position and $R_1$ occupies the 5-position.

In suitable materials, R in the compounds of the formula (1) is a radical of the formula

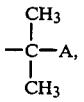

(3)

in which A is alkyl having 1 to 10 carbon atoms.

Q in the substituent R of the compound of the formula (1) is preferably $—CO_2R_4$, $—OCOR_7$ or cyano, $R_4$ and $R_7$ being as defined above.

In particularly preferred compounds of the formula (1), R is a radical of the formula (2), in which Q is $—CO_2R_4$, in which $R_4$ is alkyl having 1 to 12 carbon atoms, which is unsubstituted or is substituted by cycloalkyloxy having 3 to 12 carbon atoms or aryloxy having 6 to 10 carbon atoms, or is cycloalkyl having 3 to 12 carbon atoms, aryl having 6 to 10 carbon atoms, aralkyl having 7 to 13 carbon atoms or methyl substituted by a 5-membered or 6-membered heterocyclic ring which contains an oxygen atom and is unsubstituted, or Q is $—OCOR_7$, in which $R_7$ is alkyl having 1 to 20 carbon atoms, cycloalkyl having 3 to 12 carbon atoms, aralkyl having 7 to 13 carbon atoms or unsubstituted aryl having 6 to 10 carbon atoms, $R_1$ is a radical of the formula (2), in which Q is as defined, $R_2$ and $R_3$ independently of one another are hydrogen or alkyl having 1 to 5 carbon atoms and p, q, k and n are as defined.

A further group of particularly suitable compounds of the formula (1) is represented by the compounds of the formula

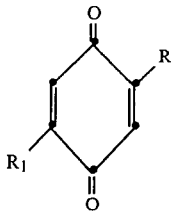

(4)

in which R is a radical of the formula (2), in which Q is $—CO_2R_4$, in which $R_4$ is alkyl having 1 to 8 carbon atoms or cycloalkyl having 5 to 8 carbon atoms, or $—OCOR_7$, in which $R_7$ is alkyl having 1 to 4 carbon atoms, $R_1$ is a radical of the formula (2), in which Q is as defined, $R_2$ and $R_3$ are each methyl, p, q and k are each 1 and n is 1 to 10, and by those compounds of the formula (4), in which R is a radical of the formula (2), in which Q is $—CO_2R_4$, in which $R_4$ is alkyl having 1 to 10 carbon atoms, cyclohexyl or a radical of the formula

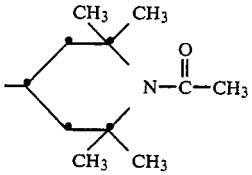

or is $—OCOR_7$, in which $R_7$ is methyl or phenyl, or is alkoxy having 1 to 10 carbon atoms or hydroxy, $R_1$ is t-butyl or a radical of the formula (2), in which Q is as defined, $R_2$ and $R_3$ are methyl, p, q and k are 1 and n is 3 to 7.

Preferred alkoxy groups Q are those having 1 to 4 carbon atoms.

The quinones of the formula (1) incorporated into photographic silver dye bleach material, represent good bleach inhibitors which are capable of oxidising reduced, that is to say active, bleach catalysts.

The quinones are incorporated in a known manner in the form of dispersions or emulsions into the photographic material. In most cases, they can dispersed without high-boiling solvents, such as di-n-butyl phthalate or tri-o-cresyl phosphate. For example, 2.5 g of the quinone are dissolved at about 40° C. in 10 ml of ethyl acetate. This solution is added to a solution, which has preferably also been warmed to 40° C., of 2 g of gelatine in about 25 ml of water and 1 ml of a wetting agent, for example sodium diisobutylnaphthalenesulfonic acid in the form of an 8% aqueous solution, and the mixture is subjected to ultrasonic dispersion for about 4 minutes. The ethyl acetate is then evaporated. The quantity of quinone depends, however, on the type of the photographic layer into which the compounds are to be incorporated. This quantity can vary within wide limits. In general, 0.01 to 5 g of quinone per $m^2$ are incorporated into the appropriate layer. The activity of the quinones according to the invention depends in addition on the particle size of the dispersion.

In a multi-layer material, the quinones can be added, depending on the desired effect, to all the layers or only to individual layers, for example silver halide emulsion layers, dye layers, silver halide emulsion dye layers, interlayers or auxiliary layers.

In multi-colour materials, the quinones are preferably incorporated into the gelatine interlayers which are free of silver halide and dye, in order to prevent diffusion of reduced bleach catalyst from one dye layer to another. This applies in particular to materials which contain silver halide emulsion layers without a dye. In this case, 0.2 to 0.5 g of quinone per $m^2$ of layer area suffice in general for completely preventing bleach coupling between two dye layers. Moreover, the quinones used according to the invention enable the layer thickness of these gelatine interlayers to be minimised.

Figure 2:
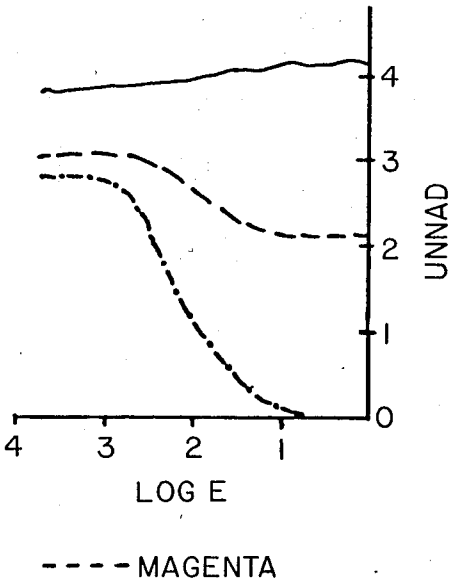
Figure 3:
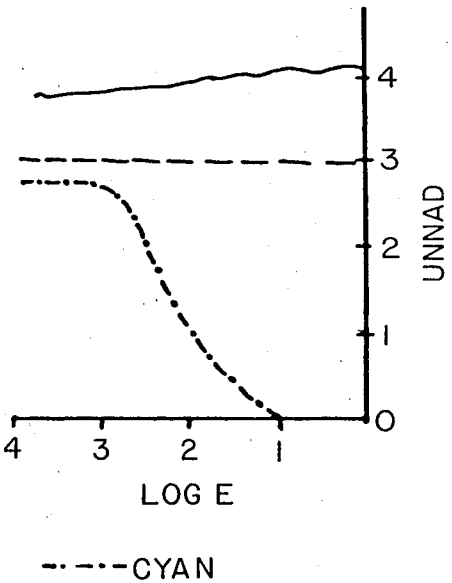

In FIGS. 1 to 3, the colour densities determined from colour wedges of multi-colour materials (see Example 3) are shown.

FIGS. 1 and 2 illustrate results obtained with photographic materials without a bleach inhibitor.

FIG. 3 relates to the results obtained with the material according to the invention (with bleach inhibitor).

FIG. 1 shows that bleaching of the magenta dye can be almost prevented by a gelatine interlayer of sufficient thickness. The magenta density hardly decreases.

By contrast, FIG. 2 shows that unduly thin gelatine interlayers can no longer suppress the diffusion of reduced bleach catalyst into the layer containing magenta dye. The magenta colour density therefore decreases steeply.

FIG. 3 shows how the same thin gelatine interlayer suffices for preventing bleaching of the magenta dye, if it contains the quinones used according to the invention as bleach inhibitors. The magenta density is fully preserved.

The quinones of the formula (1) play an essential role in the preparation of negative-working silver dye bleach material. Such a material is described, for example, in U.S. Pat. No. 2,673,800. Accordingly, the quinones are present in the emulsion layers and barrier layers and optionally further gelatine layers which likewise contain a quinone can be provided, in particular between the silver halide emulsion layers and the dye layers, which contain development nuclei for the silver complex diffusion process.

In this way, it is possible to prevent the dye, required for producing the negative colour image, in the adjacent layers from being bleached by the negative silver image formed in the emulsion layers and the silver deposited in the barrier layers on development nuclei.

The quinones of the formula (1) can also be used with advantage in filter layers and antihalo layers which contain colloidal particles of silver, and also in barrier layers which contain colloidal hydrosols or sulfides of noble metals or heavy metals.

Processing of the exposed silver dye bleach materials is in general carried out in four consecutive steps:

1. Silver development
2. Dye bleach
3. Silver bleach
4. Fixing.

In the first step, the latent silver image produced on exposure is developed. In the second step, the image dye associated with the silver is bleached corresponding to the actual imagewise distribution of the silver. The third step is necessary for reoxidising the excess image silver which is still present after the dye bleach. In the fourth step, the silver, all of which is then present in the form of halides, is removed by dissolution by means of a complex former, in particular a salt of thiosulfuric acid, in order to make the finished image insensitive to further exposure and to remove cloudiness from the pure colour image.

The second process step, namely the dye bleach, is carried out in the conventional known processes in strongly acidic medium, a catalyst being added for accelerating the dye bleach. In addition, the bleach baths contain a silver complex former or ligands. The two constituents, namely the catalyst and the ligand, are necessary in order to transfer the reducing action of the metallic, non-diffusible image silver to the likewise non-diffusible dye. The reduced form of the catalyst, formed by reduction on the image silver, here serves as a transfer agent which, after having covered a certain diffusion path, irreverisbly reduces the dye and hence bleaches it and at the same time itself is reoxidised to the original form.

A simplification of the processing method is obtained by combining the dye bleach and the silver bleach in a single process step. The combined dye and silver bleach baths (preparations) for processing the exposed silver dye bleach material contain as a rule the following quantities of the components (a) to (f):

(a) strong acid: 10 to 200 g/liter;
(b) water-soluble iodide: 2 to 50 g/liter, preferably 5 to 25 g/liter;
(c) water-soluble oxidising agent: 1 to 30 g/liter;
(d) anti-oxidiser: 0.5 to 10 g/liter;
(e) bleach catalysts: 0.05 to 10 g/liter, and, if appropriate,
(f) bleach accelerator: 1 to 5 g/liter.

As the strong acids (component (a)), the combined dye and silver bleach baths can contain alkylsulfonic or arylsulfonic acids and especially p-toluenesulfonic acid, sulfuric acid, sulfamic acid or trichloroacetic acid. Optionally, mixtures of these acids can also be used. The pH value of the bleach bath is especially not higher than 2 and preferably is not higher than 1.

The water-soluble iodides (component (b)) are as a rule alkali metal iodides, in particular sodium iodide and potassium iodide.

Advantageously, the oxidising agents (component (c)) used are water-soluble, aromatic mononitro and dinitro compounds or anthraquinone sulfonic acid derivatives, for example o- or m-nitrobenzene sulfonic acid or 2,4-dinitrobenzene sulfonic acid. The use of such oxidising agents serves to influence the colour balance and the contrast of the images produced by the dye bleach process, and this is known from DE No. 735,672 and from GB No. 539,190 and GB No. 539,509.

In addition to their function as silver bleaches, the compounds of component (c) serve to flatten the gradation.

The antioxidisers (component (d)) used are advantageously reductones or water-soluble mercapto compounds. Suitable reductones are especially aci-reductones with a 3-carbonyl-ene-1,2-diol grouping, such as reductin, triosereductone or preferably ascorbic acid. The mercapto compounds can be, for example, thioglycerol, but especially the compounds of the formula $$HS—C_qH_{2q}—B$$

or preferably $$HS—(CH_2)_m—COOH$$

in which q is an integer of a value from 2 to 12, B is a sulfonic acid or carboxylic acid group and m is one of the numbers 3 and 4.

The bleach catalysts (c) used are especially azines, in particular derivatives of quinoxaline. These are described, for example, in U.S. Pat. No. 4,202,698.

Examples of suitable bleach accelerators (f) are quaternary ammonium salts, as are known from No. DE-A-2,139,401 and No. DE-A-2,716,136. Preferably, these are quaternary, substituted or unsubstituted piperidine, piperazine, pyrazine, quinoline, pyridine or tetraalkyl ammonium compounds, as well as water-soluble tertiary phosphines as described in No. DE-A-2,651,169.

A repeat of individual treatments (each time in a further tank with a bath of the same composition as the preceding one) is possible; in this way better bath utilisation can be achieved in some cases.

All the baths can contain further conventional additives, for example hardeners, wetting agents, fluorescent brighteners or ultraviolet stabilisers.

For silver development, baths of conventional composition can be used, for example those which, as the developer substance, contain hydroquinone and optionally additional 1-phenyl-3-pyrazolidinones. Optionally the silver development bath already contains a bleach catalyst or a silver complex former, for example sodium thiosulfate.

The fixing bath can be of known and conventional composition. Examples of the fixers used are sodium thiosulfate or advantageously ammonium thiosulfate, optionally with additives, such as sodium bisulfite and/or sodium metabisulfite.

EXAMPLE 1

A layer which, per $m^3$, contains:

8.2 g of gelatine 0.27 g of the dye of the formula

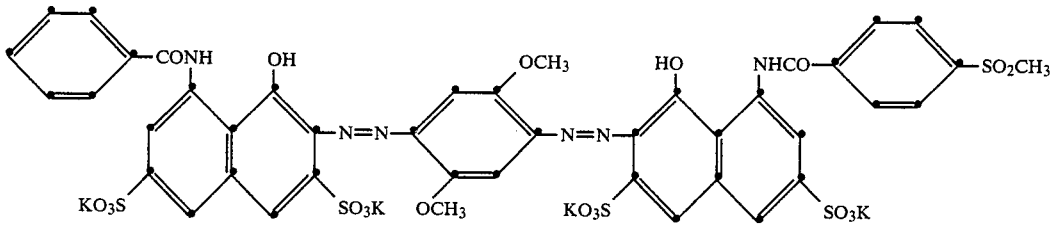

(I)

0.69 g of silver (as a silver bromide dispersion), 0.43 g of 2-amino-4-hydroxy-6-(4-methyl-morpholinium)-1,3,5-triazine tetrafluoborate, and 0.43 g of a fine dispersion of the compound of the formula

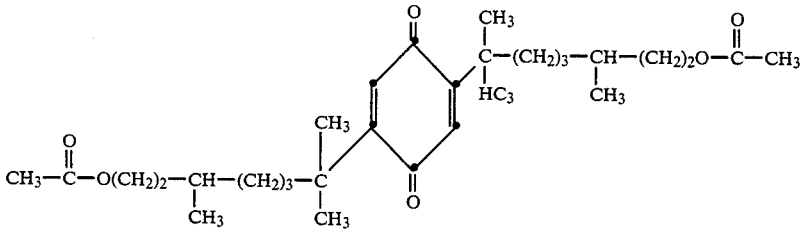

(100)

as a bleach inhibitor, is applied to an opaque cellulose triacetate support.

The same photographic element is prepared once more, but without the addition of the bleach inhibitor.

Two strips of each of these elements are exposed for two seconds with 200 Lux behind a step wedge. Subsequently one strip of the elements in each case is treated at 30° C. as follows:

| | | | |
|---|---|---|---|
| (A) | 1. Developing | 3 minutes | Bath 1 |
| | 2. Washing | 1 minute | Bath 2 |
| | 3. Bleaching | 3 minutes | Bath 3 |
| | 4. Washing | 1 minute | Bath 4 |
| | 5. Fixing | 3 minutes | Bath 5 |
| | 6. Washing | 4 minutes | Bath 6 |

The two remaining strips are processed as follows:

| | | | |
|---|---|---|---|
| (B) | 1. Developing | 3 minutes | Bath 1 |
| | 2. Washing | 1 minute | Bath 2 |
| | 3. Fixing | 3 minutes | Bath 5 |
| | 4. Washing | 4 minutes | Bath 6 |

The baths have the following compositions:

| Bath 1: Developer | |
|---|---|
| Sodium ethylenediamine-tetraacetic acid | 4 g |
| Potassium sulfite | 19.9 g |
| Sodium sulfite, anhydrous | 38.0 g |
| Sodium thiosulfate, anhydrous | 0.9 g |
| Potassium carbonate, anhydrous | 19.5 g |
| Potassium bicarbonate | 13.3 g |
| Benzotriazole | 1.0 g |
| 1-Phenyl-4-methylpyrazolidone | 0.5 g |
| Hydroquinone | 8.0 g |
| Ethylcellosolve | 57.4 g |
| Water to make up to | 1,000 ml |
| **Bath 3: Bleach bath** | |
| m-Nitrobenzenesulfonic acid | 7.5 g |
| Sulfuric acid (100%) | 41.8 g |
| Ethylcellosolve | 57.4 g |
| 2,3,6-trimethylquinoxaline | 1.1 g |
| Potassium iodide | 9.0 g |
| 4-Mercapto-butyric acid | 1.7 g |
| Bis-(β-cyanoethyl)-sulfoethylphosphine | 2.9 g |
| Water to make up to | 1,000 ml |
| **Bath 5: Fixer** | |
| Ammonium thiosulfate | 200 g |
| Ammonium sulfite | 17.9 g |
| Ammonium bisulfite | 17.9 g |
| Water to make up to | 1,000 ml |

According to (A), a clear, sharp cyan wedge is obtained for both elements, and according to (B) a silver wedge is obtained in each case, which is superposed by the dye coated in.

The cyan densities of the wedges obtained according to (A) are measured in the red spectral region by means of a reflectance densitometer. The maximum cyan density is 2.5

The silver densities are determined in the blue spectral region by means of the same instrument.

In the element without the bleach inhibitor, the cyan dye is bleached down to a density of about 0.4 in the areas of silver density of 0.5. If, however, the element contans a bleach inhibitor, the cyan dye is only bleached down to a density of about 0.9, at the same quantity of silver [the dye bleach is inhibited by the compound of the the formula (100)].

If, in place of the compound of the formula (100), the bleach inhibitors used are of the compounds of the formulae (101)

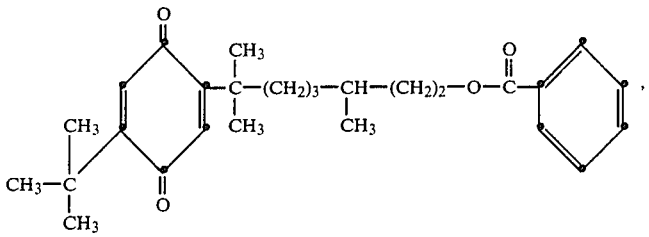

(102)

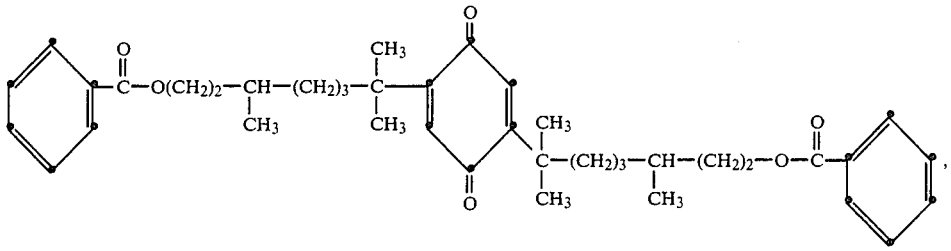

(103)

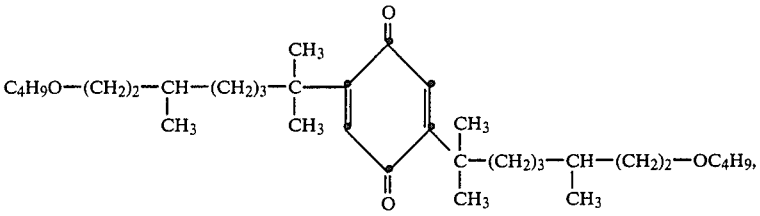

(104)

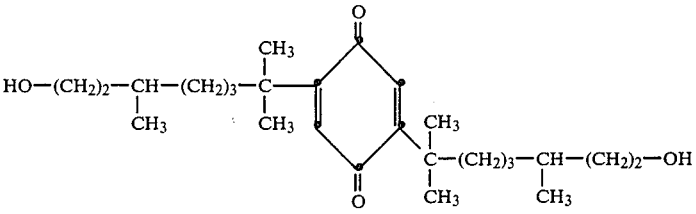

(105)

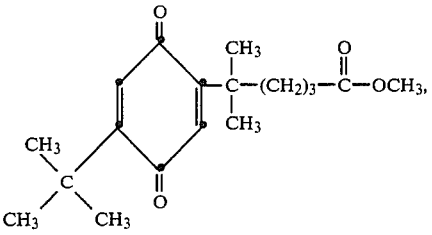

(106)

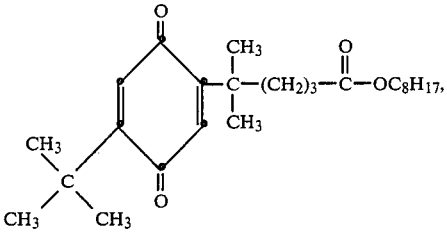

(107)

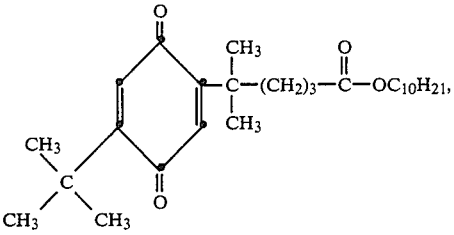

(108)

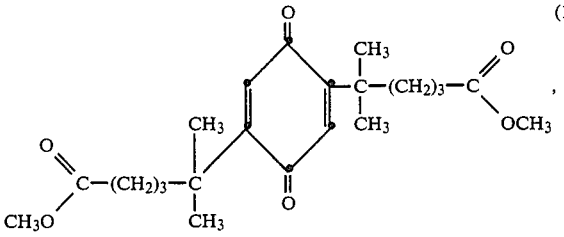

-continued
(109)
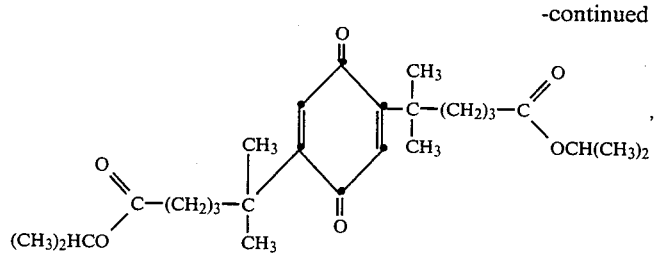
(110)
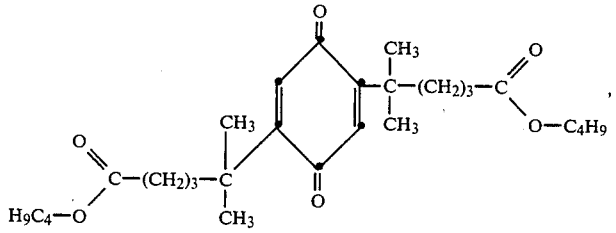
(111)
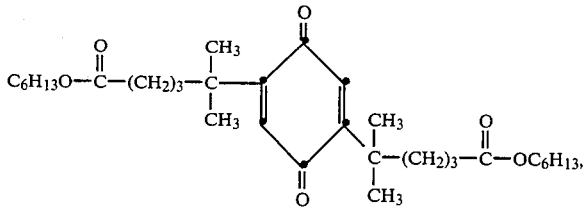
(112)
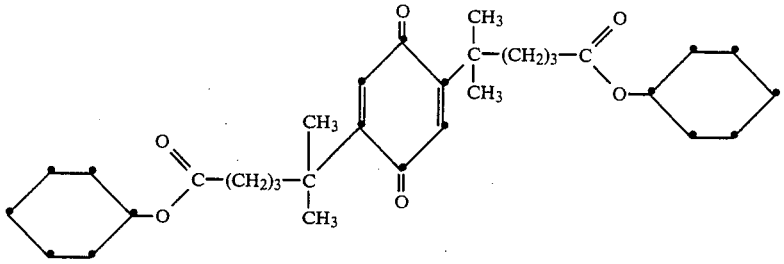
(113)
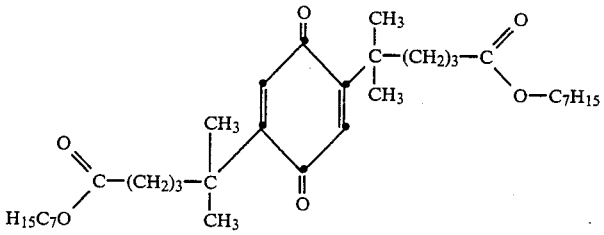
or
(114)
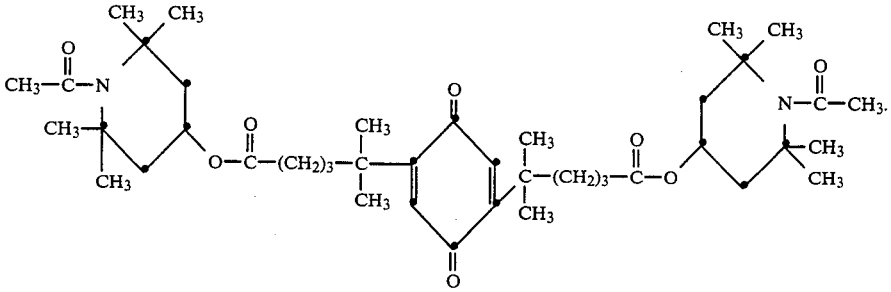
the following dye densities are obtained after exposure and processing:
TABLE
| Compound | Quantity used per $m^2$ | Dye density |
|---|---|---|
| (101) | 0.36 g | 0.65 |
| (102) | 0.54 g | 0.75 |

TABLE-continued

| Compound | Quantity used per m² | Dye density |
|---|---|---|
| (103) | 0.45 g | 0.75 |
| (104) | 0.36 g | 0.65 |
| (105) | 0.26 g | 0.60 |
| (106) | 0.35 g | 0.75 |
| (107) | 0.37 g | 0.80 |
| (108) | 0.34 g | 1.13 |
| (109) | 0.38 g | 0.96 |
| (110) | 0.41 g | 0.84 |
| (111) | 0.46 g | 0.75 |
| (112) | 0.45 g | 1.20 |
| (113) | 0.48 g | 0.86 |
| (114) | 0.62 g | 0.75 |

EXAMPLE 2

Four photographic elements are prepared which give a negative cyan image by the silver dye bleach process:

Element A:

The following layers are applied to a transparent polyester support:

A layer which per m², contains 1.6 g of gelatine 0.135 g of cyan dye of the formula (I) according to Example 1, 0.05 mg of red colloidal gold particles as development nucleii and 40 mg of 2-amino-4-hydroxy-6-(4-methylmorpholinium)-1,3,5-triazinium tetrafluoroborate as a hardener;

a layer which per m², contains 1 g of gelatine 0.05 g of the compound of the formula (100) and 20 mg of the said hardener, and a layer which, per m², contains 1.8 g of gelatine 0.4 g of silver as a red-sensitive silver chlorobromide emulsion with 25 mol-% of silver chloride and a mean particle size of 0.3 μm, and 40 mg of the said hardener.

Element B is prepared as element A, but without the bleach inhibitor in the second layer.

Element C is prepared as element A, but without the second layer.

Element D is prepared as element C, but the third layer contains 1 g/m² of the compound of the formula (100).

Samples of the elements A to D are exposed with red light in a sensitometer and are then processed as follows:

1. Silver development for 3 minutes at 30° C. in bath 1 according to Example 1.

This gives a negative silver image in the third layer and, due to silver complex diffusion and silver deposition on the development nuclei, a positive silver image in the first layer.

2. Washing for 1 minute.

3. Simultaneous dye and silver bleach for 3 minutes at 30° C. in bath 3 according to Example 1.

4. Washing for 1 minute.

5. Fixing for 3 minutes at 30° C. in bath 5 according to Example 1.

6. Washing for 4 minutes and drying of the elements.

All four elements gave a negative dye image, that is to say a counter-image of the exposure wedge. Measuring the maximum dye density in this image, the following values are obtained

| Element | A | B | C | D |
|---|---|---|---|---|
| Maximum density | 1.0 | 0.58 | 0.35 | 0.80 |

Comparing the maximum densities of the four elements with the maximum density of corresponding samples which are fixed (100%) immediately after development, the following dye loss in A to D results by comparison:

| Element | A | B | C | D |
|---|---|---|---|---|
| Dye loss | 0% | 42% | 45% | 20% |

EXAMPLE 3

Three further materials A, B and C are prepared which are suitable for the preparation of positive copies, to be viewed in reflected light, by the silver dye bleach process:

In the order given, the following layers are applied to a white-opaque support:

1. A pair of red-sensitive layers, consisting of a silver halide emulsion layer which, per m² contains 2 g of gelatine, 0.16 g of silver as silver bromoiodide and 0.15 g of the cyan dye of the formula (I), and of a silver halide emulsion layer which is free of image dye and, per m² of support surface area, contains 2 g of gelatine nd 0.30 g of silver as silver bromoiodide emulsion:

2. A gelatine interlayer (Z1):

3. A pair of green-sensitive layers consisting of a silver halide emulsion layer which, per m³ contains 2.5 g of gelatine, 0.17 g of silver as silver bromoiodide and 0.18 g of the magenta dye of the formula

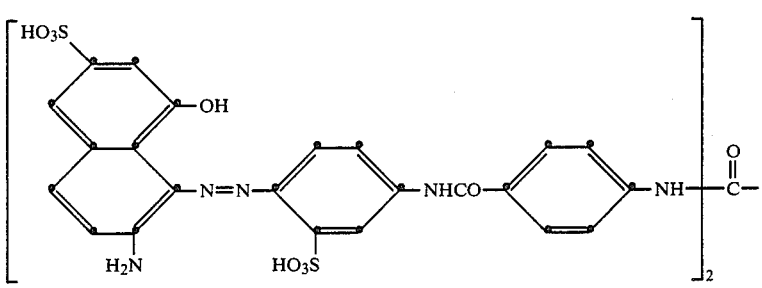

(II)

and of a silver halide emulsion layer which is free of image dye and which, per m² of support surface area, contains 2 g of gelatine and 0.30 g of silver as silver bromoiodide;

4. A second gelatine interlayer (Z2) of 4 g of gelatine and 10 mg of colloidal silver per m² of support surface area;

5. A pair of blue-sensitive layers consisting of a silver halide emulsion layer which contains, per m², 3 g of gelatine nd 0.45 g of silver as silver bromide and 0.14 g of the yellow dye of the formula

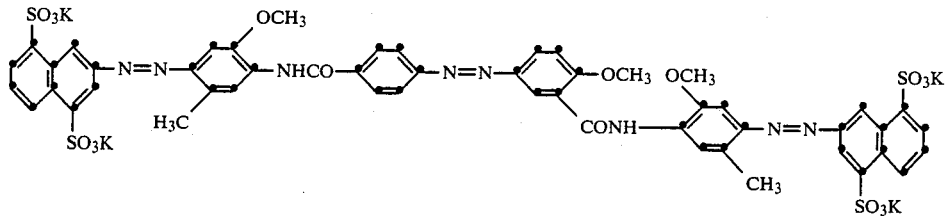

(III)

and of a silver halide emulsion layer which is free of image dye and which, per $m^2$ of support surface area, contains 2 g of gelatine nd 0.36 g of silver as silver bromide;

6. A protective gelatine layer which, per $m^2$ of support surface area, contains 1.5 g of gelatine and 0.4 g of the hardener 2-amino-4-hydroxy-6-(4-methylmorpholinium)-1,3,5-triazine tetrafluoborate.

Material A is prepared with a gelatine interlayer (Z1) which contains 4 g of gelatine per $m^2$ of support surface area.

Material B is prepared with a gelatine interlayer (Z1) which contains 1 g of gelatine per $m^2$ of support surface area.

Material C is prepared with a gelatine interlayer (Z1), consisting of 1 g of gelatine and 0.3 g of a finely divided dispersion of the compound of the formula (100) per $m^2$ of support surface area.

The materials A, B and C are exposed to red light in a sensitometer and are processed as in Example 2. This gives colour wedges, the colour of which ranges from red to black. Measuring the colour densities of the wedges with a densitometer and calculating the analytical colour densities of the three colour channels from this, the colour curves reproduced in FIGS. 1 to 3 are obtained. [The colour densities are given in "Unity neutral normalized analytical densities" UNNAD, compare A. J. Sant, Phot. Sci. Eng, 14. 356 (1970)].

It can be clearly seen that, in material A, the interlayer (Z1) is just sufficiently thick to prevent bleaching of the magenta dye. Material B (FIG. 2) with a thin gelatine interlayer (Z1) shows a dye loss of about 30% in the magenta layer, and this corresponds to a very clearly visible colour shift.

Material C (FIG. 3), by contrast does not show any dye loss in the magenta layer in spite of the equally thin interlayer (Z1) as in the material B.

What is claimed is:

1. A photographic silver dye bleach material which, in at least one layer, contains at least one compound of the formula

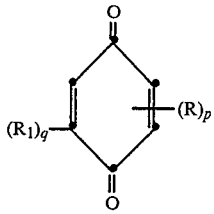

(1)

in which R is a radical of the formula

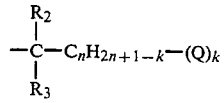

(2)

in which Q is $—CO_2R_4$, in which $R_4$ is alkyl having 1 to 20 carbon atoms, which is unsubstituted or is substituted by $—OR_6$, in which $R_6$ is cycloalkyl having 3 to 12 carbon atoms, alkenyl having 3 to 20 carbon atoms, aryl having 6 to 10 carbon atoms, which is unsubstituted or is monosubstituted or disubstituted by alkyl groups having 1 to 4 carbon atoms each, or aralkyl having 7 to 13 carbon atoms, and which may contain 1 to 5 oxygen atoms, or $R_4$ is alkenyl having 3 to 20 carbon atoms, cycloalkyl having 3 to 12 carbon atoms, aryl having 6 to 10 carbon atoms, which is unsubstituted or is substituted by alkyl having 1 to 4 carbon atoms, or is aralkyl having 7 to 13 carbon atoms, a heterocyclic ring which contains an oxygen atom or a nitrogen atom and is unsubstituted or substituted by 1, 2, or 4 alkyl groups having 1 to 4 carbon atoms each, or is methyl substituted by a 5-membered or 6-membered heterocyclic ring which contains an oxygen atom and is unsubstituted or is monosubstituted or disubstituted by alkyl groups having 1 to 4 carbon atoms each, or Q is $—CONR_4R_5$, wherein $R_4$ is as defined above and $R_5$ is hydrogen or alkyl having 1 to 20 carbon atoms or $R_4$ and $R_5$, together with the nitrogen atom to which they are linked, form a 5-membered or 6-membered ring which is unsubstituted or is monosubstituted or disubstituted by alkyl groups having 1 to 4 carbon atoms each, with the proviso that $R_5$ is different from hydrogen if $R_4$ is alkyl or aryl, or Q is —OX, in which X is $R_5$ or $—COR_7$, in which $R_5$ is as defined and $R_7$ is alkyl having 1 to 20 carbon atoms, alkenyl having 3 to 20 carbon atoms, cycloalkyl having 3 to 12 carbon atoms, aralkyl having 7 to 13 carbon atoms or aryl having 6 to 10 carbon atoms, which is unsubstituted or is monosubstituted or disubstituted by alkyl groups having 1 to 4 carbon atoms each, or Q is $—NR_8R_9$ in which $R_8$ is hydrogen or alkyl having 1 to 4 carbon atoms and $R_9$ is hydrogen, alkyl having 1 to 4 carbon atoms or $—COR_7$, in which $R_7$ is as defined above, or $R_8$ and $R_9$, together with the nitrogen atom to which they are linked, form a 5-membered or 6-membered ring which is unsubstituted or is monosubstituted or disubstituted by alkyl groups having 1 to 4 carbon atoms each, or Q is $—P(O)(OR_{10})([O]_xR_{11})$, in which x is 0 or 1, and, if x=1, $R_{10}$ and $R_{11}$ independently of one another are hyrogen or alkyl having 1 to 20 carbon atoms, or $R_{10}$ and $R_{11}$ form an alkylene group having 2 to 3 carbon atoms, which is unsubstituted or is monosubstituted or polysubstituted by alkyl groups having 1 to 20 carbon atoms each, or, if x=0, $R_{10}$ is hydrogen or alkyl having 1 to 20 carbon atoms and $R_{11}$ is unbranched alkyl having 1 to 5 carbon atoms, or Q is $—SO_2R_{12}$, in which $R_{12}$ is hydroxy, chlorine or $NR_5R_7$, in which $R_5$ and $R_7$ are as defined above, with the proviso that $R_5$ is different from hydrogen if $R_7$ is alkyl or aryl, $R_1$ being a radical of the formula (2) if $R_{12}$ is hydroxy, or Q is cyano, $R_2$ and $R_3$ independently of one another are alkyl having 1 to 5 carbon atoms and, if $Q=CO_2R_4$, $R_2$ or $R_3$ may be substituted by $—CO_2R_4$, or $R_2$ and $R_3$ can, together with the radical of the formula $—C_nH_{2n+1-k}$, form a cycloalkyl radical having 5 to 12 carbon atoms, which is monosubstituted or disubstituted by groups of the formula $—CO_2R_4$, in which $R_4$ is as defined, $R_1$ is alkyl having 1 to 8 carbon atoms or a radical of the formula (2), p is 1 or 2, q is 0 or 1, p+q having to be 1 or 2, n is 1 to 20 and k is 1 or 2, or a salt of the compound of the formula (1).

2. A material according to claim 1, wherein R in the compound of the formula (1) occupies the 2-position and $R_1$ occupies the 5-position.

3. A material according to claim 1, wherin $R_1$ in the compound of the formula (1) is a radical of the formula

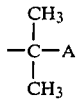

(3)

in which A is alkyl having 1 to 10 carbon atoms.

4. A material according to claim 3, wherein $R_1$ is t-butyl.

5. A material according to claim 1, wherein R in the compound of the formula (1) is a radical of the formula (2), in which Q is $—CO_2R_4$, $—OCOR_7$ or cyano, $R_4$ and $R_7$ being as defined in claim 1 and $R_1$, $R_2$, $R_3$, p q, k and n being as defined in claim 1.

6. A material according to claim 5, wherein R in the compound of the formula (1) is a radical of the formula (2), in which Q is $—CO_2R_4$, in which $R_4$ is alkyl having 1 to 12 carbon atoms, which is unsubstituted or is substituted by cycloalkyloxy having 3 to 12 carbon atoms or aryloxy having 6 to 10 carbon atoms, or is cycloalkyl having 3 to 12 carbon atoms, aryl having 6 to 10 carbon atoms, aralkyl having 7 to 13 carbon atoms or methyl substituted by a 5-membered or 6-membered heterocyclic ring which contains an oxygen atom and is unsubstituted, or Q is $—OCOR_7$, in which $R_7$ is alkyl having 1 to 20 carbon atoms, cycloalkyl having 3 to 12 carbon atoms, aralkyl having 7 to 13 carbon atoms or unsubstituted aryl having 6 to 10 carbon atoms, $R_1$ is a radical of the formula (2), in which Q is as defined, $R_2$ and $R_3$ independently of one another are alkyl having 1 to 5 carbon atoms and p, q, k and n are as defined in claim 5.

7. A material according to claim 6, wherein the compound is of the formula

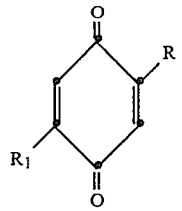

in which R is a radical of the formula (2), in which Q is $—CO_2R_4$, in which $R_4$ is alkyl having 1 to 8 carbon atoms or cycloalkyl having 5 to 8 carbon atoms, or $—OCOR_7$, in which $R_7$ is alkyl having 1 to 4 carbon atoms, $R_1$ is a radical of the formula (2), in which Q is as defined, $R_2$ and $R_3$ are each methyl and p, q and k are each 1 and n is 1 to 10.

8. A material according to claim 1, wherein the compound is of the formula

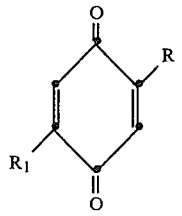

in which R is a radical of the formula (2), in which Q is $—CO_2R_4$, in which $R_4$ is alkyl having 1 to 10 carbon atoms, cyclohexyl or a radical of the formula

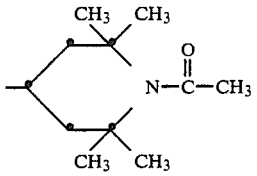

or is $—OCOR_7$, in which $R_7$ is methyl or phenyl, or is alkoxy having 1 to 10 carbon atoms or hydroxy, $R_1$ is t-butyl or a radical of the formula (2), in which Q is as defined, $R_2$ and $R_3$ are methyl, p, q and k are 1 and n is 3 to 7.

9. The material according to claim 1, wherein the compound of the formula (1) is present in a layer between a silver halide emulsion layer and a dye-containing layer associated therewith.

10. A material according to claim 1, wherein the compound of the formula (1) is present in the silver halide emulsion layer.

11. A material according to claim 1, wherein the compound of the formula (1) is present in a layer in an amount of 0.01 to 5 $g/m^2$.

12. A process for the preparation of the photographic silver dye bleach material according to claim 1, which comprises incorporating at least one compound of the formula (1) into at least one layer of the material.

13. A process for the production of a photographic image, which comprises using a material according to claim 1.

* * * * *